US005715317A

United States Patent [19]

Nakazawa

[11] Patent Number: 5,715,317

[45] Date of Patent: Feb. 3, 1998

[54] APPARATUS FOR CONTROLLING LOCALIZATION OF A SOUND IMAGE

[75] Inventor: Masayuki Nakazawa, Tsukuba, Japan

[73] Assignee: Sharp Kabushiki Kaisha, Osaka, Japan

[21] Appl. No.: 574,850

[22] Filed: Dec. 19, 1995

[30] Foreign Application Priority Data

Mar. 27, 1995 [JP] Japan ..... 7-67765

[51] Int. Cl.[6] ..... H04S 5/00

[52] U.S. Cl. ..... 381/17; 381/25

[58] Field of Search ..... 381/17, 25

[56] References Cited

U.S. PATENT DOCUMENTS

| | | | |
|---|---|---|---|
| 5,181,248 | 1/1993 | Inanaga et al. | 381/25 |
| 5,187,692 | 2/1993 | Haneda et al. | 381/63 |
| 5,369,725 | 11/1994 | Iizuka et al. | 395/2.16 |
| 5,404,406 | 4/1995 | Fuchigami et al. . | |
| 5,596,644 | 1/1997 | Abel et al. | 381/17 |

FOREIGN PATENT DOCUMENTS

| | | |
|---|---|---|
| 5252598 | 9/1993 | Japan . |
| 5300599 | 11/1993 | Japan . |
| 698400 | 4/1994 | Japan . |

OTHER PUBLICATIONS

"C Language –Digital Signal Processing "by Kageo Akitsuki et al., published by Baifukan pp. 136–189 and p. 212.

"Spatial Hearing ", Blauert, Morimoto, Goto et al. published by Kajima Institute Publishing Co., Ltd. pp. 1–207.

*Primary Examiner*—Forester W. Isen

[57] ABSTRACT

The present invention discloses a sound image localization apparatus for localizing a sound image at an arbitrary location in three-dimensional space by adding an attenuation in distance to a digital filter in order to reduce an operation time of convolution and approximating the head related transfer function in a three-dimensional space thereby to control the localization in real time. The sound image localization control apparatus comprises a location sensor for three-dimensional measuring of the direction and location of a listener's head, a microprocessor for correcting sound pressure attenuation in proportion to the distance between a sound source and the head relative to a digital filter that approximates the head related transfer function consistent with the direction of the head, and a convolution processor for convolving the corrected digital filter with the monaural sound source data.

7 Claims, 12 Drawing Sheets

FIG. 3

| | | | | |
|---|---|---|---|---|
| Amplitude | | | | |
| Sample rate | | | | |
| Number of channels | | | | |
| Number of azimuth | | | | |
| Number of elevation | | | | |
| Number of AR' s tap | | | | |
| Number of MA' s tap | | | | |
| Size of memory area | | | | |
| Size of ARMA data | | | | |
| Size of time delay data | | | | |
| Azimuth No | Elevation No | Channel | MA coefficient | AR coefficient |
| : | : | : | : | : |
| Azimuth No | Elevation No | Channel | MA coefficient | AR coefficient |
| Azimuth No | Elevation No | Time delay coefficient | | |
| : | : | : | | |
| Azimuth No | Elevation No | Time delay coefficient | | |

FIG. 4

| | | | |
|---|---|---|---|
| Amplitude | | | |
| Sample rate | | | |
| Number of channels | | | |
| Number of azimuth | | | |
| Number of elevation | | | |
| Sampling numbers | | | |
| Size of memory area | | | |
| Size of Impulse Response data | | | |
| Size of time delay data | | | |
| Azimuth No | Elevation No | Channel | Coefficient |
| : | : | : | : |
| Azimuth No | Elevation No | Channel | Coefficient |
| Azimuth No | Elevation No | Time delay coefficient | |
| : | : | : | |
| Azimuth No | Elevation No | Time delay coefficient | |

APPARATUS FOR CONTROLLING LOCALIZATION OF A SOUND IMAGE

BACKGROUND OF THE INVENTION

1. Field of the Invention

The present invention relates to an apparatus for controlling the localization of a sound image, and in particular, to a sound image localization control apparatus that calculates a head related transfer function based on three-dimensional location and direction information obtained from a position sensor for detecting a position of a listener's head and that performs a convolution operation of a monaural sound source with the calculated head related transfer function to localize a sound image in an arbitrary location.

2. Description of the Background Art

For localization control of a sound image in three-dimensions, consideration of a path through which sound waves from a sound source reach a listener's ears (ear drums), that is, transfer paths such as reflection, diffraction, and scattering from walls, and consideration of other transfer paths such as reflection, scattering reverberation, diffraction, and resonance via a listener's head and pinnas, which is called a head related transfer function, have conventionally been required. Many attempts are currently being made to continue such research in various fields. A large number of documents on the theory that the head related transfer function is utilized to localize a sound image outside of a listener's head have been published, and one of distinguished documents is "Spatial Hearing" by Brawelt, Morimoto, Goto, at el. published by Kashima Shuppan. The theory in an article was published about thirty years ago, and has already been well known. This theory is currently now in use.

For example, the outside localization headphone listening apparatus disclosed in Japanese Patent Application Laying Open (KOKAI) No. 5-252598 uses a pair of headphones and a sound image localization filter to enable localization of a sound image outside of listener's head.

This method is directed to localizing a sound image without obtaining information on each listener's spatial characteristics of human beings (the head related transfer function (HRTF)) and his or her ears' responses to the headphones, by using spatial characteristics of human beings and inverse headphone responses that are prepared in advance.

An outside localization headphone listening apparatus is described below with reference to FIG. 13.

The outside localization headphone listening apparatus comprises an A/D conversion section 301 for converting analog signals from a sound source into digital signals, a sound source storage section 304 for storing the digital sound from the sound source, and a change-over switch 307 being connected to both of the A/D conversion section 301 and the sound source storage section 304. The change-over switch 307 has connected thereto a convolution operation section 302 constituting a sound image localization filter for simulating the transfer characteristics of space. The convolution operation section 302 has connected thereto a spatial impulse response storage section 305 for storing data for setting filter coefficients as a set of a small number of typical filter coefficients in advance, an inverse headphone impulse response storage section 306, and a D/A conversion section 303 for converting digital signals outputted from the convolution operation section 302 into analog signals. The convolution operation section 302 comprises a right ear convolution operation section 302R and a left ear convolution operation section 302L.

Next, the operation of this conventional example is described.

The databases in the spatial impulse response storage section 305 and the inverse headphone impulse response storage section 306 are used in order to select and generate an optimum sound image localization filter for a particular user. This enables localization of a sound image outside of a listener's head without measuring each listener's responses.

In addition, the sound apparatus disclosed in Japanese Patent Application Laying Open (KOKAI) No. 5-300599 is a sound apparatus that reduces required measurement steps and the capacity of storage memory by binauralization at arbitrary angles through arithmetic operations. This binauralization at arbitrary angles is with respect to a horizontal plane.

Next, the sound apparatus disclosed in Japanese Patent Application Laying Open (KOKAI) No. 5-300599 is described with reference to FIG. 14.

This sound apparatus comprises a memory 401 that stores head related transfer functions for the right and left ears measured at a plurality of angles divided at a specified interval. The memory 401 is connected to a control circuit 402 and registers 4021L, 4022L, 4021R, and 4022R. The registers 4021L and 4022L, and 4021R and 4022R are connected to arithmetic operation circuits 403L and 403R for executing interpolation operations, respectively, and the arithmetic operation circuits 403L and 403R are connected to convolution circuits 404L and 404R for convolving head related transfer functions that have been arithmetically calculated with signals from a monaural sound source 405, respectively. Headphones 406L and 406R are connected to the convolution circuits 404L and 404R, respectively.

Next, the operation of this conventional example is described.

Signals from the control circuit 402 are supplied to the memory 401 that has stored therein head related transfer functions for the right and left ears measured at a plurality of angles divided at a specified interval in order to read transfer functions at specified angles including an arbitrary angle at which the sound image should be localized. The transfer function read from the memory 401 are written to the registers 4021L and 4022L, and 4021R and 4022R, signals from which are supplied to the arithmetic operation circuits 403L and 403R for interpolation, respectively. A signal for controlling the ratio for interpolation is supplied by the control circuit 402 to the arithmetic operation circuits 403L and 403R, which execute arithmetic operations according to this ratio. The calculated head related transfer functions are supplied to the convolution circuits 404L and 404R where the factors are arithmetically convolved with signals from the monaural signal source 405 and then supplied to the right and left headphones 406R and 406L.

The image sound localization apparatus disclosed in Japanese Patent Application Laying Open (KOKAI) No. 6-98400 enables a listener to clearly distinguish a sound image localized in front from a sound image localized behind. A sound image location manipulation device comprises a direction dial and a distance slider to arbitrarily localize a sound image by controlling differences between two sound signals in time, amplitude, and phase. In accordance with the operation of a direction dial **509*a* and a distance slider 509*b* in a sound image location manipulation device 509 in FIG. 15, a location of the sound image is determined. Then, signals Tl and Tr for controlling the delay time, signals Cl and Cr for controlling the amplitude, and a signal F/B for switching the sound image localized location between the front and rear of the listener is outputted from a control parameter generator 510 based on an angle signal θ and a distance signal D outputted from the sound image location manipulation device 509. Based on these various control signals, specified differences in time and amplitude are applied to input audio signals ASL by a delay device 501 and a multiplier 503, and the signal is outputted from a headphone amplifier 505 to a headphone 506. To localize a sound image behind the listener, an invertor 507 inverts the phase of one of channels in response to the signal F/B, and a signal is outputted from the headphone amplifier 505 to the headphone 506 through the delay device 502 and the multiplier 504**.

The outside localization headphone listening apparatus disclosed in Japanese Patent Application Laying Open (KOKAI) No. 5-252598 is directed to localize a sound image by using spatial characteristics of human beings and inverse headphone responses that are prepared in advance, and this application does not disclose means for arbitrarily changing a localized location within a limited range and continuously changing the location, or how to reduce the operation time of the convolution.

In addition, the sound apparatus disclosed in Japanese Patent Application Laying Open (KOKAI) No. 5-300599 carries out binauralization with respect to only a horizontal plane, and this application fails to refer to localization in arbitrary spatial locations. It discusses the reduction of measuring steps and the capacity of memory for storage, but does not mention methods for reducing the operation time of the convolution.

Furthermore, the sound image localization apparatus disclosed in Japanese Patent Application Laying Open (KOKAI) No. 6-98400 separately controls differences in time, amplitude, and phase, and this application also fails to refer to methods for reducing the operation time of the convolution. Of course, the reduction of used memory is important to the implementation of a sound image localization apparatus, but the operation time of the convolution is more important and affects hardware designs. The practical problem is thus how to reduce the order of these arithmetic operations to shorten the operation time of the convolution.

SUMMARY OF THE INVENTION

It is an object of this invention to provide a sound image localization apparatus for localizing a sound image at an arbitrary location in a three-dimensional space and reducing the operation time of the convolution by adding sound attenuation in distance to the interpolation estimation of a head related transfer function in a three-dimensional space.

It is another object of this invention to provide a sound image localization apparatus for controlling the localization of a sound image at an arbitrary location in a three-dimensional space in real time.

These and other objects can be achieved by a sound image localization control apparatus according to a first aspect of the invention which inputs signals from a monaural sound source and outputs a stereo signal for localizing a sound image at an arbitrary location in a three-dimensional space, comprising a measuring means for measuring the location and direction of a listener's head in the three-dimensions, a digital filter arithmetic operation means for determining a digital filter that approximates the head related transfer function corresponding to the measured direction of the head, a digital filter correction means for correcting the coefficient for the digital filter by calculating the amount of sound attenuation based on the measured direction of the head, and a convolution operation means for convolving the sound source data with the digital filter.

In this sound image localization control apparatus, the measuring means measures the location and direction of a listener's head in the three-dimensions, the digital filter arithmetic operation means determines a digital filter that approximates the head related transfer function corresponding to the direction of the head, the digital filter correction means calculates the amount of sound attenuation in distance based on the direction of the head and corrects the coefficient for the digital filter, and the convolution operation means arithmetically convolves the sound source data with the digital filter. This provides controlling of the sound image localization at an arbitrary location in the three-dimensional space according to the location and direction of the listener's head.

The digital filter arithmetic operation means preferably comprises an ARMA parameter arithmetic operation means for an IIR digital filter that approximates the head related transfer function, a transfer function interpolation means for interpolating the approximated head related transfer function in an arbitrary direction, and a signal power correction means for adjusting the balance of the volume for both ears which is provided by the interpolated head related transfer function.

In the digital filter arithmetic operation means of this embodiment, the ARMA parameter arithmetic operation means for an IIR digital filter causes the digital filter to approximate the head related transfer function, the transfer function interpolation means further interpolates the digital filter in an arbitrary direction, and the signal power correction means adjusts the balance of the volume for both ears which is provided by the interpolated head related transfer function. The use of the IIR digital filter to approximate the head related transfer function enables reduction of the order of the filter, thereby shortening the arithmetic operation time. Thus, hardware costs can be reduced, and the sampling rate can be set at a high value to enlarge a frequency range of controlling a sound image.

The ARMA parameter arithmetic operation means preferably includes a table that stores a plurality of IIR digital filter coefficients or a plurality of impulse responses to head related transfer functions for each direction.

In the ARMA parameter arithmetic operation means of this configuration, the table stores a plurality of IIR digital filter coefficients or a plurality of impulse responses to head related transfer function for each direction. This enables a head related transfer function to be approximated simply by referring to the table to thereby reduce the arithmetic operation time, storage capacity, and costs and to enable the sampling rate to be set at a high value in order to enlarge the frequency range of controlling a sound image.

The signal power correction means preferably comprises a signal power arithmetic operation means for calculating the signal power outputted from the IIR digital filter to both ears and a signal power adjustment means for adjusting the output balance of the volume to both ears.

In the signal power correction means of this embodiment, the signal power arithmetic operation means calculates the signal power outputted from the IIR digital filter to both ears, and the signal power adjustment means adjusts the balance of the output volume to both ears. This enables control of the localization of a sound image in an arbitrary three-dimensional location according to the location and direction of the listener's head.

The digital filter correction means preferably comprises a distance variation calculation means for determining the distance between the sound source and the listener's head to calculate the amount of sound pressure attenuation in proportion to the distance and a correction means for correcting the digital filter coefficient.

In the digital filter correction means of this embodiment, the distance variation calculation means determines the distance between the sound source and the listener's head to calculate the amount of sound pressure attenuation in proportion to the distance, and the correction means corrects the digital filter coefficient. This provides controlling of the sound image at an arbitrary location in the three-dimensional space according to the location of the listener's head.

The convolution operation means preferably comprises a ring buffer means.

The use of the ring buffer means for convolution processing reduces work memory processing during the convolution process thereby improving the processing speed.

The transfer function interpolation means is preferably configured so as to carry out the interpolation by using four digital filters stored in the table.

In the transfer function interpolation means of this embodiment, interpolation is executed by the four digital filters in the table in which a plurality of IIR digital filter coefficients or a plurality of impulse responses to head related transfer function is stored for each direction. This enables a head related transfer function for three-dimensional space to be efficiently interpolated.

This apparatus preferably comprises a location sensor as the measuring means, a first arithmetic operation processing device as the digital filter arithmetic operation and correction means, and a second arithmetic operation processing device as the convolution operation means. It is also preferable that the location sensor measures the location and direction of the head at a specified time interval and that the first arithmetic operation processing means communicates with the second arithmetic operation processing means to control the localization of a sound image in real time each time the direction or location of the head is changed.

In the sound image localization control apparatus of this configuration, the location sensor measures the location and direction of the listener's head in the three-dimensions, the first arithmetic operation processing device determines a digital filter that approximates the head related transfer function corresponding to the direction of the listener's head and calculates the amount of sound pressure attenuation in proportion to the distance between the sound source and the head in order to correct the digital filter coefficient, and the second arithmetic operation processing device arithmetically convolves the monaural sound source data with the corrected digital filter. The location sensor senses the location and direction of the listener's head at a specified time interval, and communicates with the second arithmetic operation processing device each time the location or direction of the head is changed. This enables the localization of a sound image to be controlled in real time in accordance with the movement of the listener's head.

Further objects and advantages of the present invention will be apparent from the following description of the preferred embodiments of the invention as illustrated in the accompanying drawings.

BRIEF DESCRIPTION OF THE DRAWINGS

FIG. 3 shows a format in which coefficients for an IIR digital filter are stored;

FIG. 4 shows a format in which impulse responses to head related transfer function is stored;

DESCRIPTION OF THE PREFERRED EMBODIMENTS

Figure 1:
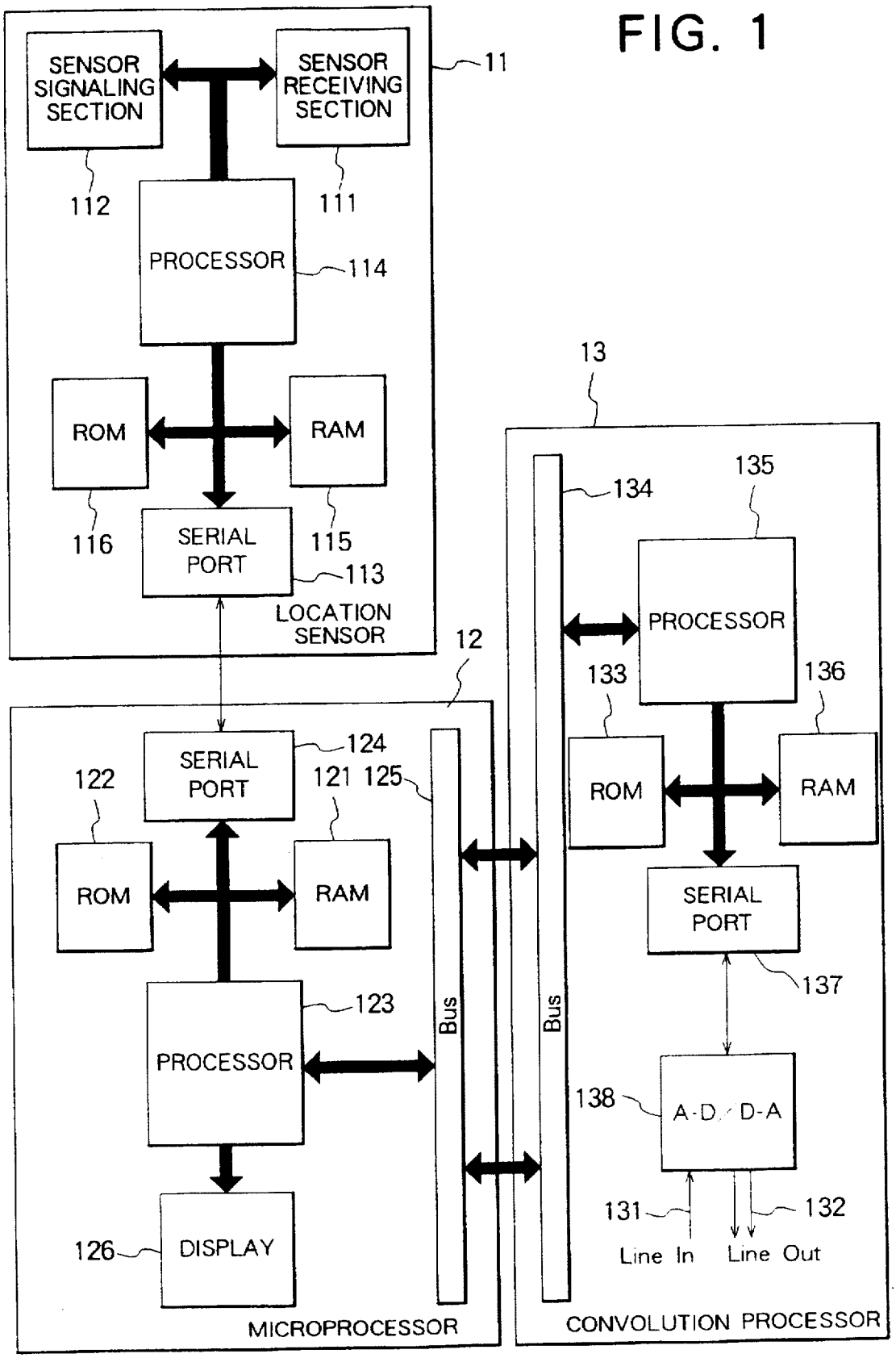
FIG. 1 is a block diagram showing the overall constitution of a sound image localization control apparatus according to an embodiment of this invention.

An embodiment of a sound image localization control apparatus according to this invention is described below with reference to the drawings. In the following description, digital filters refer to IIR digital filters unless otherwise specified.

The sound image localization control apparatus according to this embodiment comprises a location sensor 11 as a measuring device for measuring the direction and location of a listener's head in the three-dimensions; a microprocessor 12 as both a digital filter arithmetic operator for calculating the head related transfer function corresponding to the location and direction of the head and also interpolating the transfer function, and a digital filter corrector for calculating and correcting the amount of sound pressure attenuation in proportion to the distance between a sound source and the head; and a convolution processor 13 as a convolution operator for convolving the monaural sound source with a digital filter obtained with the order of the digital filter and approximation errors of the head related transfer function taken into consideration.

The location sensor 11 detects the location and direction of the sound source relative to the listener's head, and uses magnetic field effects or the delay of the arrival of electric and sound waves. The location sensor 11 thus comprises a sensor receiving section 111, sensor signaling section 112, a serial port 113 for external communications, a processor 114 for executing communications and converting sensor information to location information, and a RAM 115 and ROM 116 for storing communication protocols, sensor correction information, and sensor initialization parameters.

The microprocessor 12 operates based on control programs stored in the RAM 121 and ROM 122 under the control of a processor 123, and transmits to a serial port 124 various instructions required to obtain information on the location and direction of the sound source. From the obtained location information, the microprocessor 12 also calculates a digital filter coefficient for localizing a sound image in the obtained location, and transmits to a bus 125 information required for localization such as a digital filter coefficient. It can also visually display location information and digital filter coefficients through a display 126.

The convolution processor 13 arithmetically convolves monaural signals from a line-in 131 with the digital filter coefficient stored in the RAM 136 and outputs a stereo signal to a line-out 132. After performing initialization with information stored in the ROM 133, the convolution processor 13 receives from a bus 134 information required for localization such as a digital filter coefficient. This information is stored in the RAM 136 together with control programs for controlling the processor 135. At a specified processing interval, the convolution processor 13 inquires of the microprocessor 12 whether or not the location or direction has been changed, and if the data have been changed, instructs it to transmit the information required for localization such as a digital filter coefficient. Otherwise, it continues convolution processing. Monaural signals inputted from the line-in 131 are subjected to an analog-digital/digital-analog conversion by the A-D/D-A 138, then inputted to the processor 135 through the serial port 137.

FIGS. 3 and 4 show the formats of tables in which a plurality of head related transfer function and digital filter coefficients used by the microprocessor 12 are stored for each direction. FIG. 3 shows a format in which coefficients for the IIR digital filter are stored, and FIG. 4 shows a format in which impulse responses to head related transfer functions are stored. The format in FIG. 3 stores MA and AR coefficients, while the format in FIG. 4 stores sample values of the impulse response. To support three-dimensional space, these tables store horizontal (azimuth) and vertical (elevation) data and its order. The amplitude in the first entry is required because the absolute value of the coefficient is limited to the range of 0 to 1 due to the corresponding restriction imposed by the convolution processor. This is not required if there is no such restriction. The sample rate indicates the sampling interval of the stored data. In this embodiment, the sample rate of 44.1 KHz is used as a reference in both tables.

Figure 2:
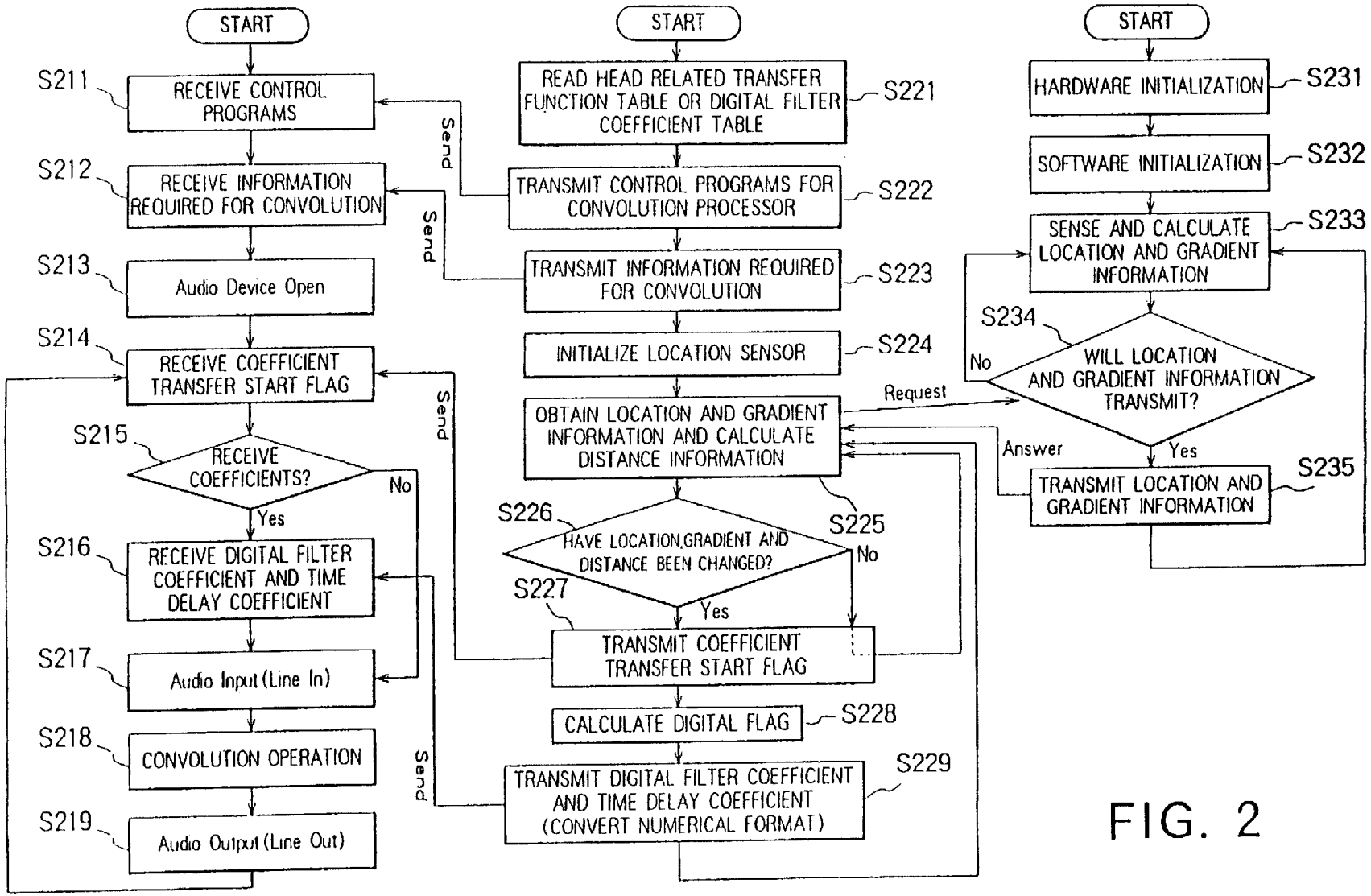
FIG. 2 is a flowchart showing the processing procedure of the sound image localization control apparatus in FIG. 1.

Next, the operation of this embodiment is described according to the flowcharts in FIG. 2.

First, the operation of the location sensor 11 is described according to the flowchart on the right of FIG. 2.

The location sensor 11 initializes hardware, that is, the sensor receiving section 111 and the sensor signaling section 112 (S231), and then obtains initialization information from the microprocessor 12 to initialize software as to whether a location in three-dimensional space is calculated in centimeters or inches (S232). The sensor subsequently carries out sensing to calculate location and directional information (S233). The sensor then determines whether or not the microprocessor 12 is sending a request signal for transmission of the location and directional information (S234). If the request signal has been sent, location sensor 11 transmits X, Y, and Z coordinates, Yaw, Pitch, and Roll data to the serial port 113 as location and gradient information, which is then sent to the microprocessor 12 (S235).

Next, the operation of the microprocessor 12 is specifically described with reference to the flowchart in the center of FIG. 2.

The microprocessor 12 first reads the table in which a plurality of head related transfer functions are stored for each direction or the table in which a plurality of digital filter coefficients are stored for each direction (S221). It subsequently transmits control programs for the convolution processor 13 to the convolution processor 13 through the bus 134 (S222). The number of memory regions required to store the sample rate, number of channels, number of azimuths, number of elevations, number of the taps of the digital filter, and digital filter coefficients that are stored in the table are sent to the microprocessor (S223). The microprocessor 12 subsequently sends the location sensor 11 an initialization signal to the serial port 124 (S224). After the location sensor 11 has been initialized, the microprocessor 12 sends a request signal for location and directional information to the serial port 124, and then obtains the information from the same serial port 124 to calculate the relative distance between the sensor receiving section 111 and the sensor signaling section 112 (S225). The sensor receiving section 111 usually represents the location of the listener's head, while the sensor signaling section 112 typically represents the location of the sound source. When obtaining this information for the first time, the microprocessor unconditionally determines that a change has occurred in the next step where it is determined whether or not the location, direction, and distance have been changed (S226). It subsequently sends to the convolution processor 13 a coefficient transfer start flag indicating the start of transmission of a time delay coefficient (S227).

Figure 7:
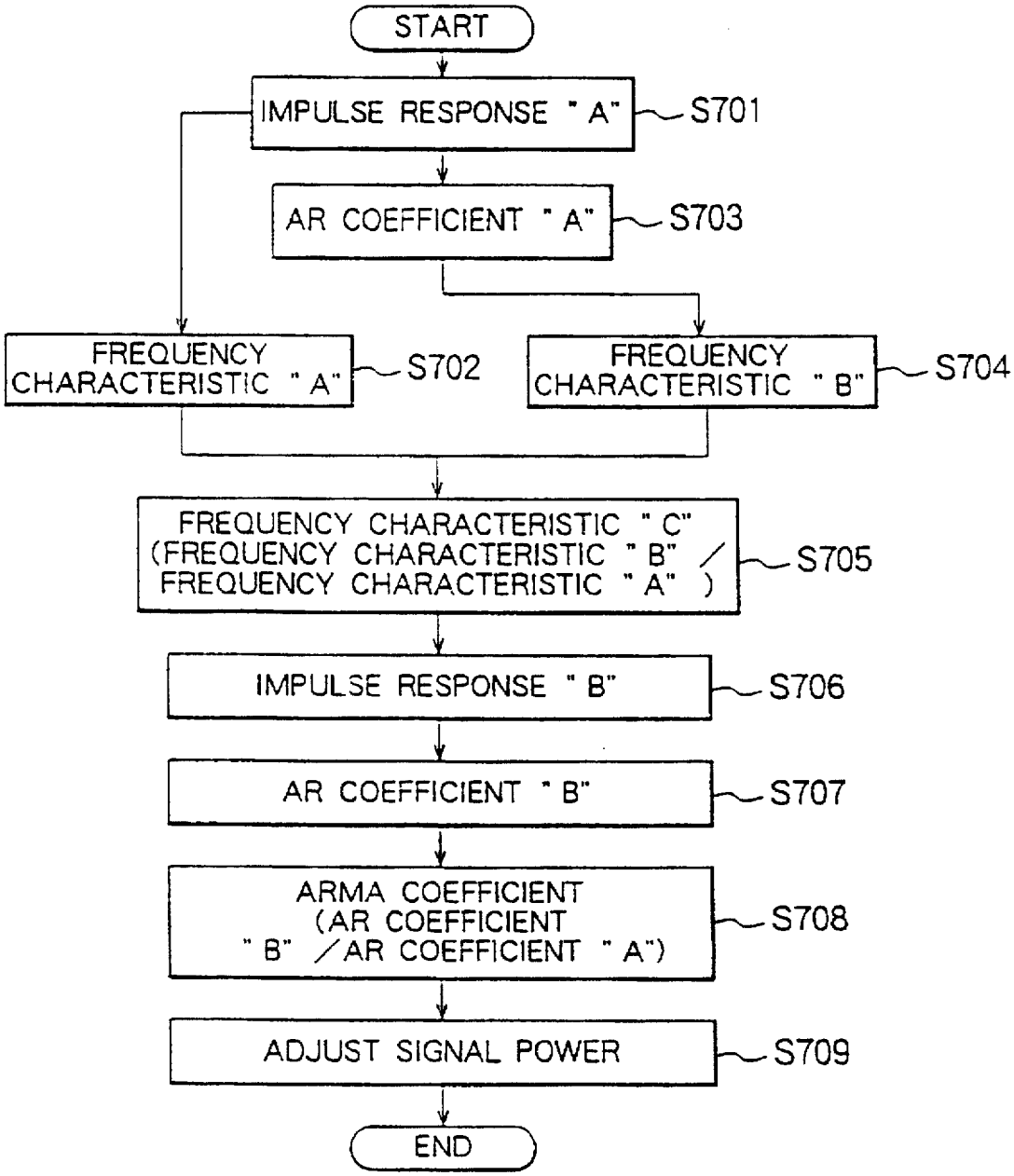
FIG. 7 is a flowchart showing arithmetic operations for determining a digital filter.

The microprocessor then calculates a digital filter coefficient according to the interpolation of the head related transfer function in FIG. 5 and the digital filter arithmetic operation in FIG. 7, which are described below (S228), and sends the number of digital filter coefficients and a time delay coefficient to the convolution processor 13 (S229). If this is not the first time that the location and gradient information have been obtained, the microprocessor determines in the next step whether or not the location, direction, and distance have been changed (S226), and if the data have been changed, calculates a digital filter coefficient according to the procedures in FIGS. 5 and 7 to transmit the result to the convolution processor 13. The microprocessor again obtains location and directional information and calculates distance information if they have not been changed (S225). If the microprocessor obtains location and gradient information for the first time, it unconditionally determines that the location and direction have been changed, and performs the processing in the above steps.

When a digital filter coefficient is transmitted, excess processing may be required depending on whether the coefficient is of an integral type or a fixed or floating point type. This depends on the difference in the representation of the numerical format used in the memory of the microprocessor 12 and the representation of the numerical format used in the memory of the convolution processor 13. This is mainly because the convolution processor employs a format that is suitable to its fast arithmetic operations and which differs from the IEEE format used as the standard. The format may be converted by the microprocessor 12 before transmitting a coefficient to the convolution processor 13 or by the convolution processor 13 after receiving the coefficient, and which method is used depends on trade-offs concerning the processing speeds of the microprocessor 12 and the convolution processor 13 and the amount of memory. In the sound image localization control apparatus according to this embodiment, the microprocessor 12 executes this task (S229).

Next, the operation of the convolution processor 13 is specifically described with reference to the flowchart on the left of FIG. 2.

The convolution processor 13 first receives control programs sent by the microprocessor 12 through the bus 134 (S211). The convolution processor 13 subsequently receives the number of memory regions required to store the sample rate, the number of channels, the number of azimuths, the number of elevations, the number of the taps of the digital filter (same as the order of the digital filter), and digital filter coefficients that are similarly sent through the bus 134 (S212). After securing memory for the digital filter, it opens the line-in 131 for inputting mortaural sound signals and the line-out 132 for outputting stereo sound signals after convolution processing (S213). It then attempts to receive a digital filter coefficient transfer start flag from the microprocessor 12 (S214), and determines whether or not a coefficient will be received (S215). If a digital filter coefficient and a time delay coefficient will be sent by the microprocessor 12 through the bus 134, the convolution processor 13 receives the coefficients (S216) and stores them in the RAM 136. It subsequently reads a monaural sound signal from the line-in 131 (S217), arithmetically convolves this signal with the digital filter according to the convolution operation flow shown in FIG. 8 (S218), and then outputs a stereo sound signal to the line-out 132 (S219). If the coefficients are not received, it immediately convolves the monaural sound signal with the digital filter (S218).

Figure 8:
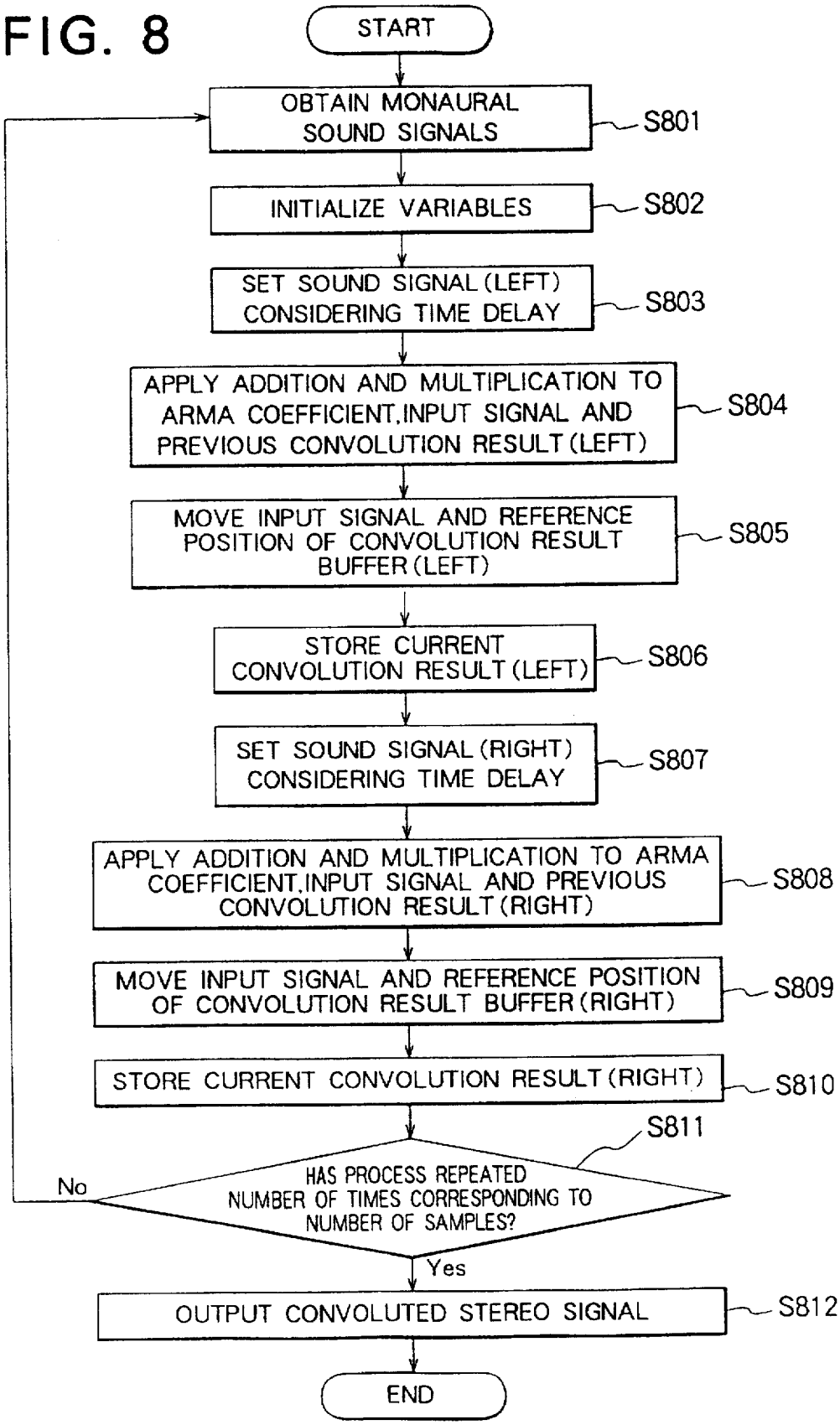
FIG. 8 is a flowchart showing convolution arithmetic operation processing.
Figure 9:
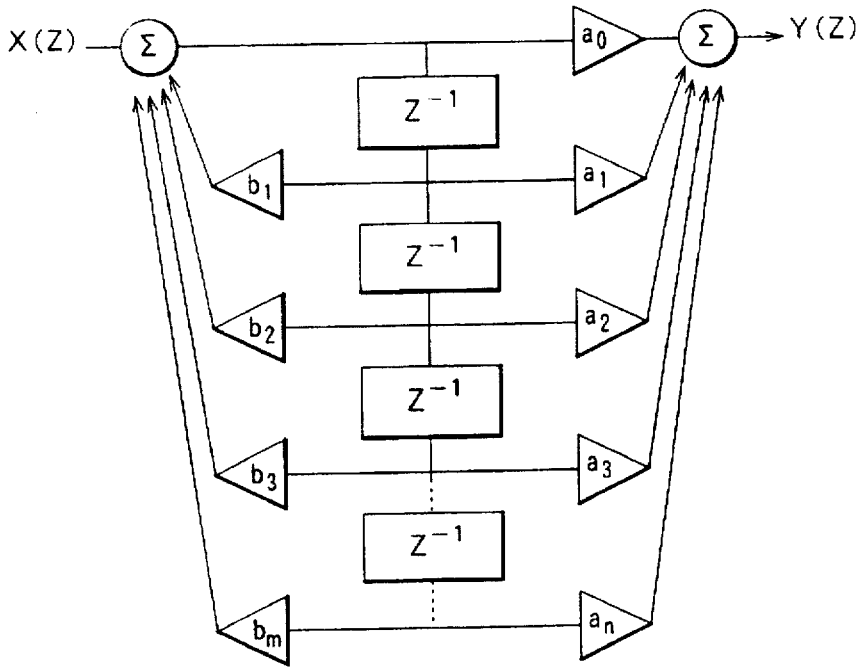
FIG. 9 is a block diagram showing a convolution operation.

In this convolution operation processing, a ring buffer is used to reduce the amount of processing. FIG. 8 shows a flowchart showing this process (described below in detail). A memory for previous outputted results is ordinarily used because they are required after the convolution operation due to the nature of the convolution operation expression shown below and FIG. 9 showing this operation.

$$H(z)=\frac{Y(z)}{X(z)}=\frac{\sum_{n=0}^{N} a_n z^{-n}}{\sum_{m=0}^{M} b_m z^{-m}}$$

$$Y(z)=\frac{a_0+a_1z^{-1}+\ldots+a_Nz^{-N}}{b_0+b_1z^{-1}+\ldots+b_Mz^{-M}}\,X(z)$$

$$Y(z)=\frac{a_0X(z)+a_1z^{-1}X(z)+\ldots+a_Nz^{-N}X(z)-b_1z^{-1}Y(z)-\ldots-b_Mz^{-M}Y(z)}{b_0}$$

$$y(n)=\frac{a_0x(n)+a_1x(n-1)+\ldots+a_Nx(n-N)-b_1y(n-1)-\ldots-b_My(n-M)}{b_0}$$

$$y(n)=a_0x(n)+a_1x(n-1)+\ldots+a_Nx(n-N)-b_1y(n-1)-\ldots-b_My(n-M)$$

Figure 10:
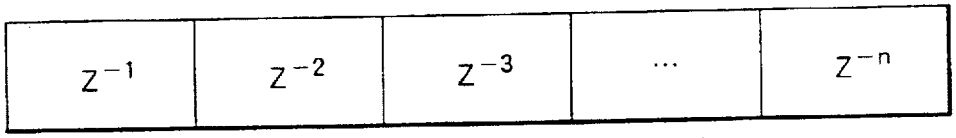
FIG. 10 is a conceptual drawing showing a linear work memory.
Figure 11:
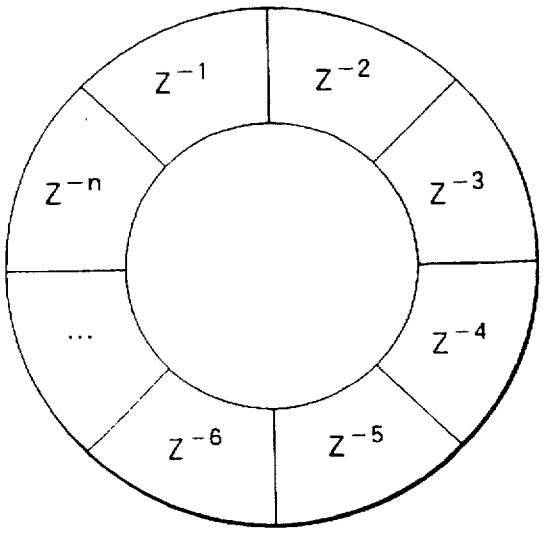
FIG. 11 is a conceptual drawing showing a ring type work memory.

In the above expression and in FIG. 9, Z indicates a Z conversion, and Z raised to n-th power indicates the delay of sampling. H(z) is a transfer function, and Y(z) denotes a Z conversion for output y(n), while X(z) indicates a Z conversion for input x(n). Signs $a_0$ to $a_N$ denote digital filter MA coefficients. Signs $b_0$ to $b_N$ denote digital filter RA coefficients. Previous outputted results are sequentially updated, so the reference position is changed simultaneously with the update or an addition of the position. Since this work memory is usually linear as shown in FIG. 10, the contents of this memory must be shifted by one entry after one outputted result has been obtained. In the convolution operation processing by the sound image localization control apparatus according to this invention, the ring memory shown in FIG. 11 is used instead of the linear work memory shown in FIG. 10. This eliminates the need to shift the contents of the memory by one entry, and enables this process to be performed simply by shifting the reference position, thereby reducing the number of steps in the control programs and increasing the processing speed. In this case, Z also indicates the Z conversion, and Z raised to n-th power also indicates the delay of sampling (outputted result).

The method for estimating the head related transfer function at an arbitrary direction in three-dimensional space is described with reference to FIG. 6 that is a conceptual view showing an interpolation process.

Figure 6:
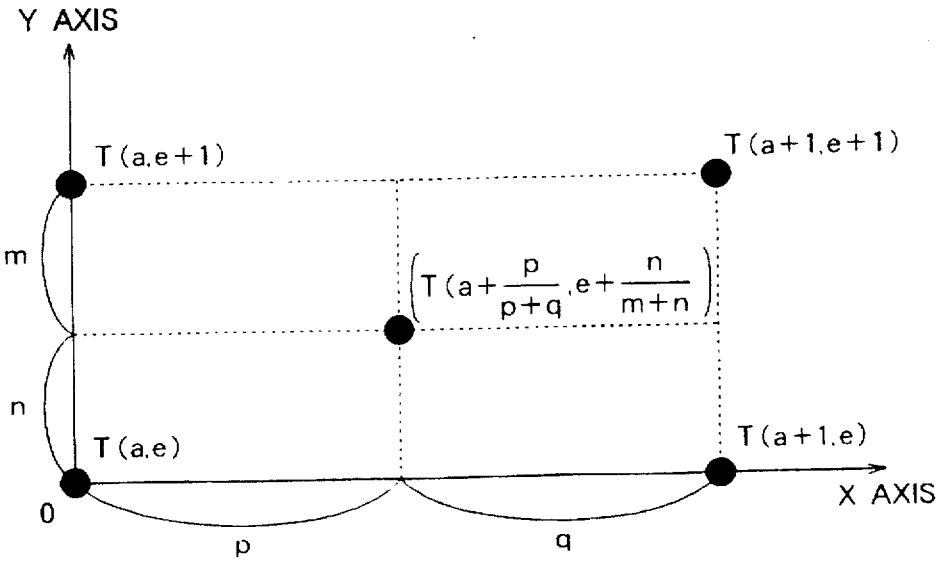
FIG. 6 is an explanation view showing the concept of the interpolation of a head related transfer function.

T (a, e) in FIG. 6 indicates a transfer function at azimuth (a) and elevation (e), and T (a, e), T (a, e+1), T (a+1, e), and T (a+1, e+1) are known and given by arithmetic operations on the digital filter table or by the head related transfer function table. If a desired location is assumed to be the center of the FIG. 6, that is, the point located at {a+p/(p+q), e+n/(m+n)}, the head related transfer function T{a+p/(p+q), e+n/(m+n)} for this location can be determined by the following expression using interpolation based on the ratio.

To extend this to three-dimensional space, interpolation may be executed on the three planes in three-dimensional space (the x-y, y-z, and x-z planes in terms of the x, y, z coordinate system). Interpolation may thus be carried out using four points including a point that is a reference coordinate (four head related transfer functions).

$$T\{a+p/(p+q),\ e+n/(m+n)\}=[T(a,e)+p/(p+q)\{T(a+1,e)-T(a,e)\},\ T(a,e)+n/(m+n)\{T(a,e+1)-T(a,e)\}]$$

Figure 5:
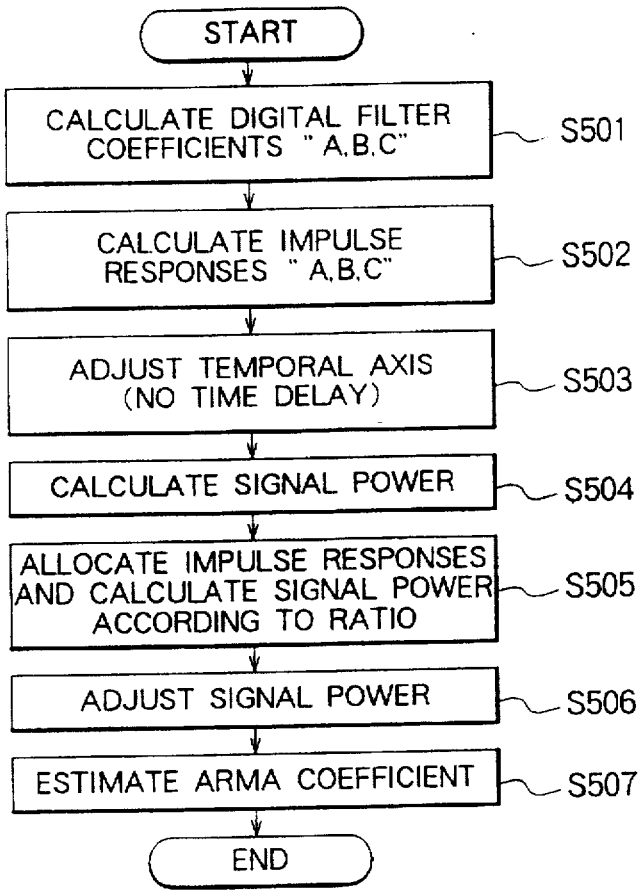
FIG. 5 is a flowchart for the interpolation of a head related transfer function.

Next, the method for interpolating a head related transfer function is explained according to the flowchart in FIG. 5.

When the transfer function table is given as digital filter coefficients, a flow in which digital filter coefficients are arithmetically convolved with impulses to calculate impulse responses is required (S501), but the rest of the operation is the same as when impulse responses have been given. That is, three impulse responses A, B, and C located adjacent to each other in a desired direction are selected (S502). The time delay is eliminated from the impulse responses (S503). That is, the rising edge of a signal in each channel starts at zero on the temporal axis, and there is no time difference at the point of the rising edge. Each signal power is then calculated (S504). The following expression is used wherein N indicates the number of impulse response samples and wherein X denotes an impulse response coefficient.

$$\text{Signal Power}=\sum_{i=0}^{N-1} X[i]\times X[i]$$

The impulse responses and signal power are allocated according to the ratio, and the impulse response and signal power in the desired direction are determined from the three impulse responses (S505). The signal power is adjusted to the determined impulse responses (S506), and an IIR filter is estimated using an ARMA model (S507).

The method for calculating an IIR digital filter coefficient using an ARMA model is specifically explained with reference to the flowchart in FIG. 7. In this flow, the ARMA model is calculated on the basis of an AR model. The extensive and general approach described in detail in "C Language—Digital signal Processing" by Kageo Akitsuki, Yauso Matsuyama, and Osamu Yoshie published by Baifukan is used as a method for determining a digital filter coefficient for the AR model.

First, an impulse response A is given (S701), and a frequency characteristic A is determined (S702). An AR coefficient is then calculated from the impulse response A (S703), and the frequency characteristic B of a digital filter using the AR coefficient is determined (S704). The difference between the frequency characteristic A and the frequency characteristic B is determined as a frequency characteristic C (S705). An impulse response B with the frequency characteristic C is determined (S706), and an AR coefficient B corresponding to this impulse response B is again calculated (S707). These two AR coefficients are used as an AR and MA coefficients for the ARMA model to finally calculate the IIR digital filter coefficient (S708). In this method, the difference in frequency characteristic that cannot be approximated by only the first AR coefficient A is determined again as the MA coefficient.

Finally, the signal power of the IIR digital filter is adjusted so as to be equal to the signal power of the impulse response (S709). For the order of the AR and MA coefficients, as a result of audition experiments on errors due to the difference between the frequency characteristic of the impulse response A and the frequency characteristic of the IIR digital filter which has finally been determined, as shown in FIGS. 12*a* and 12*b*, the smallest order has been adopted.

Figure 12A:
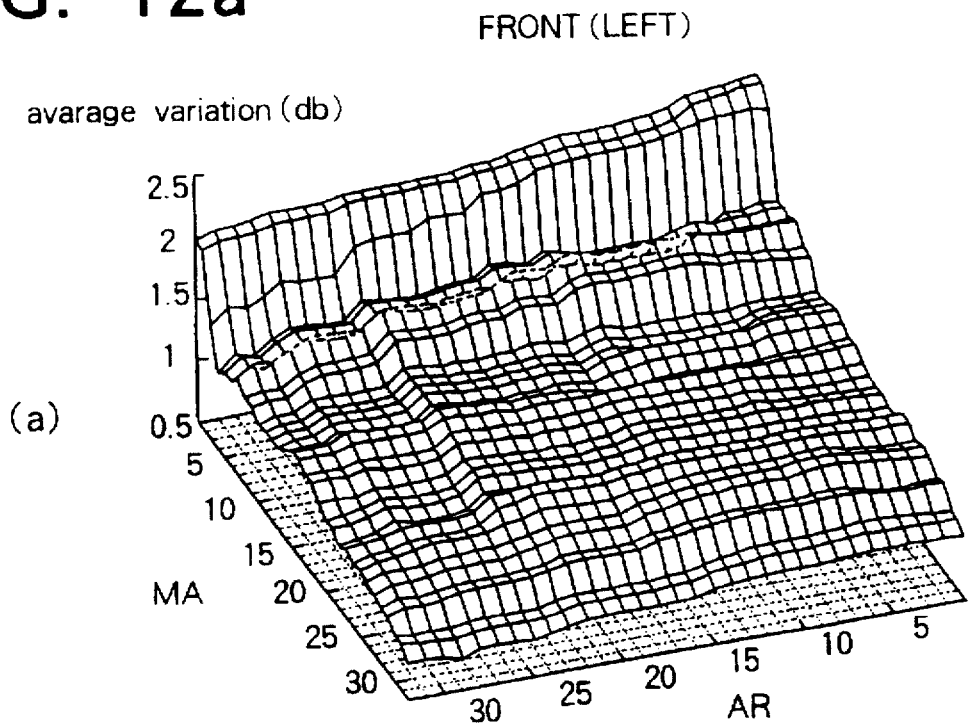
FIGS. 12*a* and 12*b* show an error due to the difference between an AR coefficient and an MA coefficient in order.
Figure 12B:
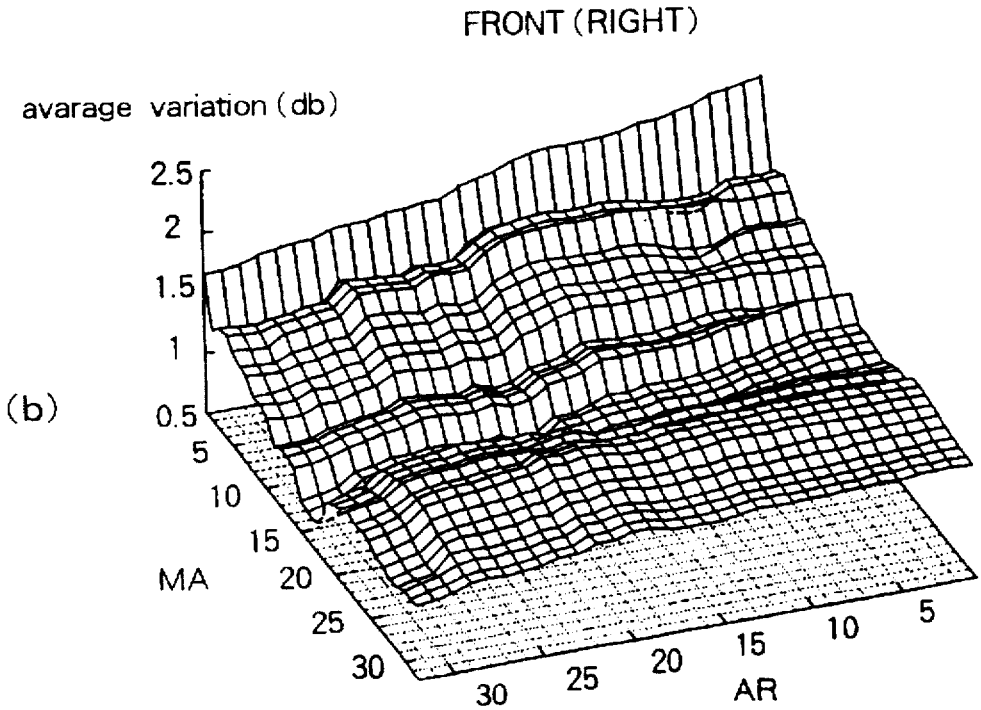
Figure 13:
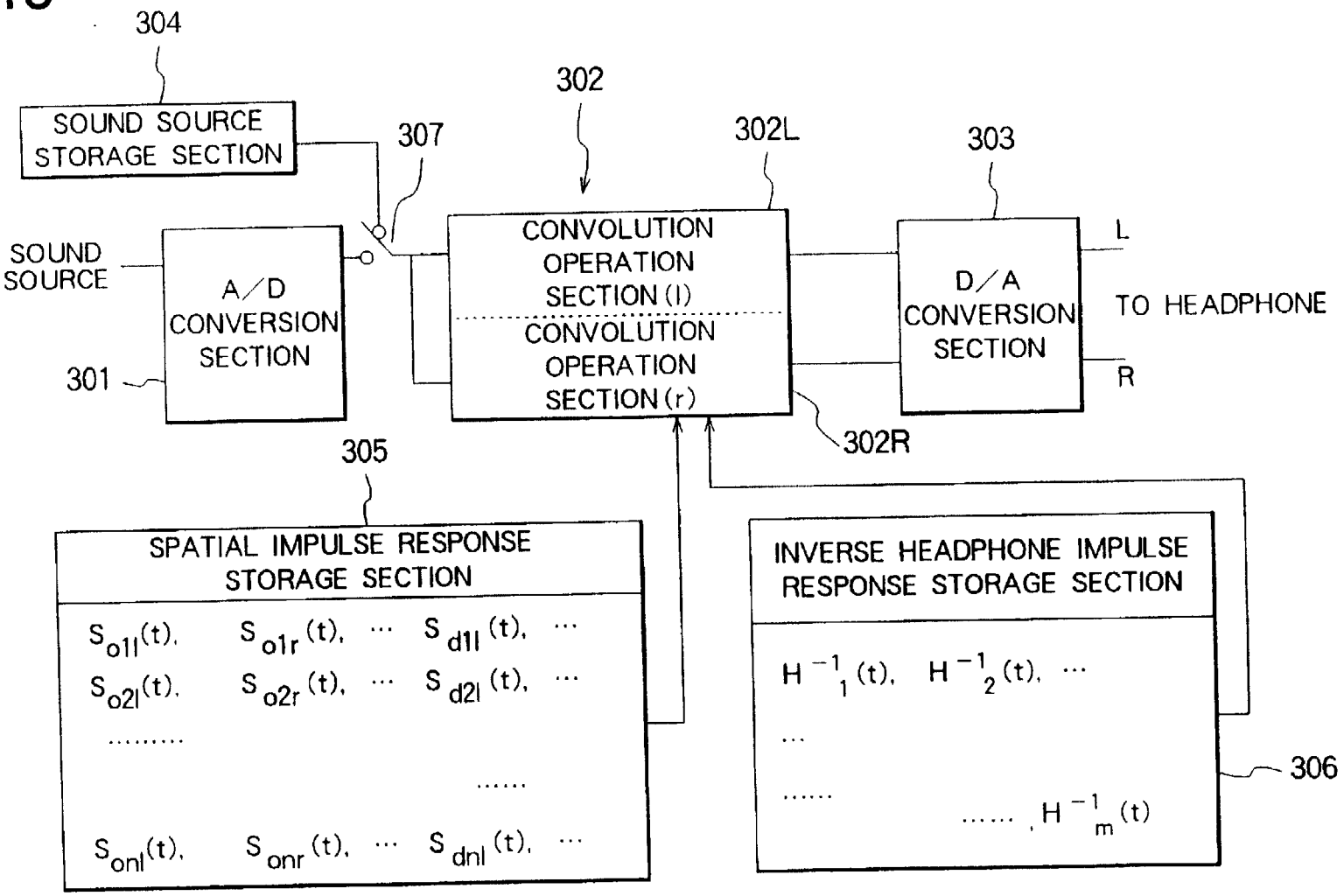
FIG. 13 is a block diagram showing a conventional outside localization headphone listening apparatus.
Figure 14:
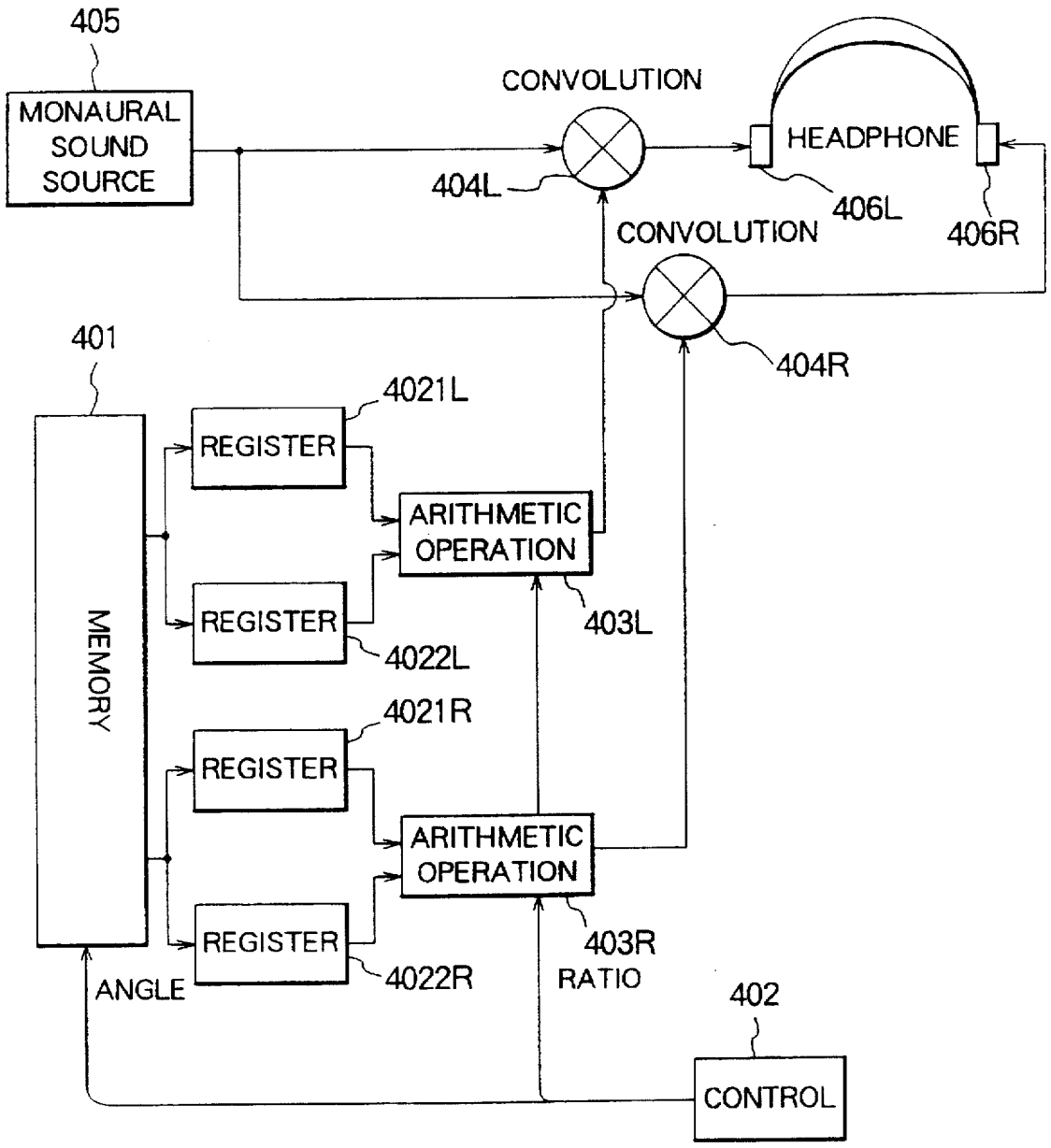
FIG. 14 is a block diagram showing a conventional sound apparatus.
Figure 15:
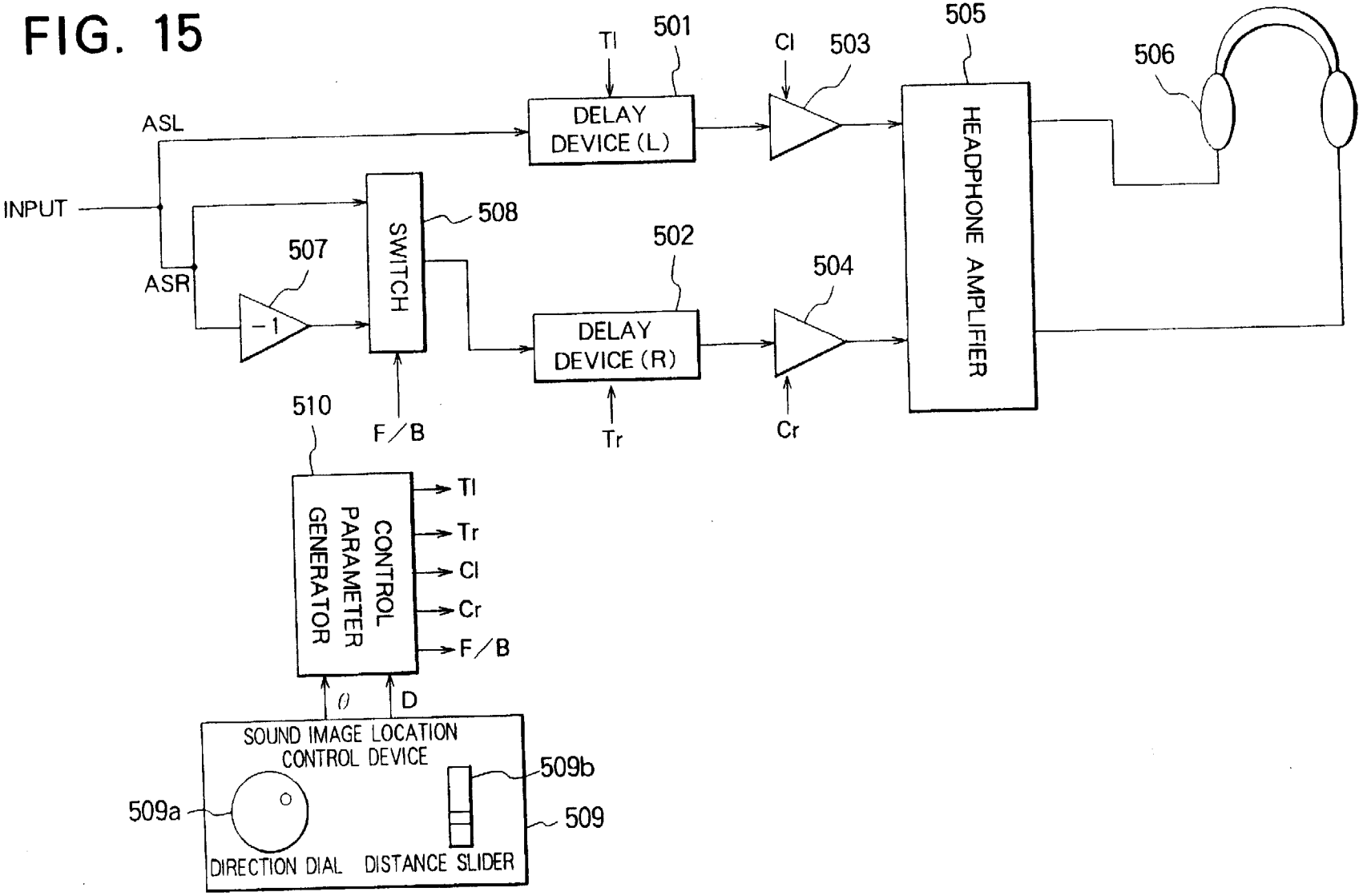
FIG. 15 is a block diagram showing a conventional sound image localization apparatus.

FIGS. 12*a* and 12*b* show examples of right and left IIR digital filters in the front within a horizontal plane. The MA and AR axes indicate the orders of the respective coefficients, and the vertical axis denotes the difference in average sound pressure which is the error in frequency characteristic in each order. In either case, the error is smallest when the MA or AR has the largest order, but the minimum error is observed in other orders. In the right front, the error is minimum when the order of the MA coefficient is about 15 and when the AR coefficient is about 18 and 32. This embodiment employs the order that is small, that involves small errors, and that enables appropriate localization in audition experiments.

Finally, the convolution operation is described according to the flowchart in FIG. 8.

After monaural sound signals have been inputted until a certain size of buffer has been filled, the convolution processor 13 attempts to separately process time series, that is, starts processing the first sample signal. The left is first processed, and the right is then processed. First, one sample is picked up (S801), a variable for the results of convolution operations which are outputted to both ears is initialized (S802). The time delay for the left ear is taken into consideration, and the input sound signal is subjected to time delay (S803). The microprocessor 12 arithmetically convolves the digital filter coefficient (the ARMA coefficient) stored in the RAM 136 on the convolution processor 13 with the input signal and the previous convolution result (S804). The input signal and the referencing position of the previous convolution result buffer are subsequently moved (S805), and the result is then stored in the ring buffer (S806). For the convolution processing for the right ear, the input signal is subjected to time delay (S807), and a multiplication and an addition are applied to the ARMA coefficient, input signal, and previous convolution result (S808), same as the left ear. The input signal and the reference position of the previous convolution result buffer are subsequently moved (S809), and the result is then stored in the ring buffer (S810). This series of processing is repeated the number of times corresponding to the number of samples read from the line-in 131 (S811). A convolution result is then outputted from the line-out 132 as a stereo signal (the output processing, however, is not included in the convolution arithmetic operation flow).

As described above, input monaural sound signals to the line-in 131 of the convolution processor 13 are finally outputted from the line-out 132 of the convolution processor 13 as a stereo sound signal.

The bus 125 to the microprocessor 12 and the bus 134 to the convolution processor 13 need not be connected to the respective processors via a bus line, and connections with serial ports enable communications. In this case, however, the transfer speed, that is, the baud rate should be high. In addition, the serial port 113 of the location sensor 11, the serial port 124 of the microcomputer 12, the serial port 137 of the convolution processor 13, and the A-D/D-A converter 138 can be connected via bus lines. In this case, the use of bus lines increases the amount of location and directional information transferred per unit time and the analog to digital or digital to analog transfer speed, thereby enabling a larger amount of information to be transmitted.

Many widely different embodiments of the present invention may be constructed without departing from the spirit and scope of the present invention. It should be understood that the present invention is not limited to the specific embodiments described in the specification, except as defined in the appended claims.

What is claimed is:

1. A sound image localization control apparatus for inputting signals from a monaural sound source and outputting a stereo signal in order to localize a sound image at an arbitrary location in three-dimensional space, comprising:

measuring means for measuring a location and a direction of a listener's head in three-dimensions and for outputting x, y and z coordinates and yaw, pitch and roll data;

digital filter arithmetic operation means for determining an approximated digital filter of a head related transfer function corresponding to the measured direction of the listener's head;

digital filter correction means for calculating an amount of sound attenuation on the basis of the measured direction of the listener's head so as to correct a coefficient of said digital filter; and convolution operation means for convolving data from said monaural sound source with said digital filter corrected by said digital filter correction means, said digital filter arithmetic operation means including ARMA parameter arithmetic operation means, of an IIR digital filter, for approximating the head related transfer function with an AR coefficient and then determining an MA coefficient for a difference in frequency characteristic that can not be approximated by the AR coefficient, transfer function interpolation means for interpolating the approximated head related transfer function at an arbitrary direction, and signal power correction means for adjusting volume balance of the interpolated head related transfer function for both ears of the listener's head.

2. The sound image localization control apparatus according to claim 1, wherein said signal power correction means comprises:

signal power arithmetic operation means for calculating signal power of said IIR digital filter for both ears; and signal power adjustment means for adjusting the volume balance of the calculated signal power for both ears.

3. The sound image localization control apparatus according to claim 1, wherein said ARMA parameter arithmetic operation means includes a table for storing one of a plurality of IIR digital filter coefficients and a plurality of impulse responses to the head related transfer function for each direction.

4. The sound image localization control apparatus according to claim 3, wherein said transfer function interpolation means interpolates the head related transfer function by using four IIR digital filter coefficients stored in said table.

5. The sound image localization control apparatus according to claim 1, wherein said digital filter correction means comprises:

distance variation calculation means for determining a distance between said monaural sound source and the listener's head and calculating an amount of sound pressure attenuation in proportion to the distance; and correction means for correcting a coefficient of said digital filter.

6. The sound image localization control apparatus according to claim 1, wherein said convolution operation means includes a ring buffer.

7. The sound image localization control apparatus according to claim 1, wherein said measuring means includes a location sensor, said digital filter arithmetic operation processing means and said digital filter correction means include a first arithmetic operation processing device and said convolution operation means includes a second arithmetic operation processing device, said location sensor measuring the location and direction of the listener's head at a specified interval and said first arithmetic operation processing device communicating with said second arithmetic operation processing device so as to control localization of a sound image in real time each time the direction or the location of the listener's head changes.

* * * * *